United States Patent [19]

Okazaki

[11] 4,441,093

[45] Apr. 3, 1984

[54] THERMAL FUSE AND THE METHOD OF MANUFACTURING THE SAME

[76] Inventor: Tasuku Okazaki, 535-81, Nishi 3-chome, Nakayama-cho, Nara City, Nara Prefecture, Japan

[21] Appl. No.: 366,674

[22] Filed: Apr. 8, 1982

[30] Foreign Application Priority Data

Apr. 28, 1981 [JP] Japan ..... 56-64420
Feb. 9, 1982 [JP] Japan ..... 57-20567

[51] Int. Cl.[3] ..... H01H 37/76

[52] U.S. Cl. ..... 337/404; 29/623; 337/407

[58] Field of Search ..... 337/404, 402, 405, 407; 29/623

[56] References Cited

U.S. PATENT DOCUMENTS

| | | | |
|---|---|---|---|
| 533,183 | 1/1895 | Storrs | 337/404 |
| 2,354,111 | 7/1944 | Gardenhour | 337/404 |
| 2,764,025 | 9/1956 | Otto | 337/404 |
| 3,625,195 | 3/1972 | McIntosh et al. | 337/404 |
| 4,198,617 | 4/1980 | Hara | 337/405 |

FOREIGN PATENT DOCUMENTS

| | | | |
|---|---|---|---|
| 277151 | 1/1928 | Fed. Rep. of Germany | 337/407 |
| 1588097 | 5/1973 | Fed. Rep. of Germany | 337/407 |
| 6611797 | 2/1967 | Netherlands | 337/407 |

*Primary Examiner*—Harold Broome
*Attorney, Agent, or Firm*—Wenderoth, Lind & Ponack

[57] ABSTRACT

A thermal fuse comprises a coiled spring interposed in a stretched condition between two opposed conductors in such a fashion that the spring is imparted with tension and is soldered by a fusible alloy having a specified fusing point. The coiled spring is cut at one portion so that a circuit between the two conductors is broken upon fusing of the fusible alloy due to the action of the coiled spring cut at one portion.

8 Claims, 6 Drawing Figures

THERMAL FUSE AND THE METHOD OF MANUFACTURING THE SAME

BACKGROUND OF THE INVENTION

This invention relates to thermal fuses or temperature responsive circuit breakers which are simple in construction and yet high in precision of temperature sensitivity, and to a method of manufacturing such thermal fuses.

Generally, thermal fuses are roughly divided into two types, namely, one which uses an organic substance as its temperature sensing part and another which uses an inorganic substance as its temperature sensing part.

The type which uses an organic substance is capable of (instantaneous disconnection) but is poor in weather resistance and moisture-resistance. Therefore, it must be hermetically sealed. But when it is used at a place or under a condition where ambient temperature fluctuations are large, the hermetical sealing is lost due to thermal expansion or thermal shrinking of a receptacle, material used, etc. and erroneous motion is often caused. On the other hand, the type which uses an inorganic substance is inferior to the former type with respect to the fusible characteristic but is not necessarily required to be hermetically sealed. Therefore, the latter type has been used widely.

The thermal fuse according to the present invention makes the most of the merits of both types and is designed to be good for continuous use under conditions of high temperature.

BRIEF DESCRIPTION OF THE INVENTION

The nature and advantages of the present invention will be understood more clearly from the following description made with reference to the accompanying drawings, in which.

DETAILED DESCRIPTION OF THE INVENTION

Figure 1:
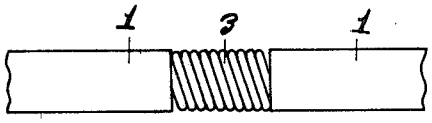
FIG. 1 is a front view showing a heat-resisting coiled spring interposed in a compressed condition between opposing two conductors, with opposite ends of the spring connected to respective of the conductors.
Figure 2:
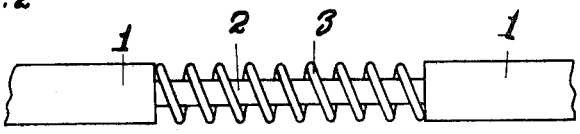
FIG. 2 is a similar view showing a hest-resisting rod member of the specified dimensions inserted in the hollow of the coiled spring in such a fashion that the coiled spring itself is imparted with tension.
Figure 3:
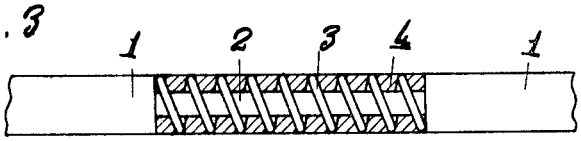
FIG. 3 is a similar view, partially in section, showing the coiled spring and connecting ends of the conductors soldered by being soaked in a molten fuse alloy of the specified melting point.
Figure 4:
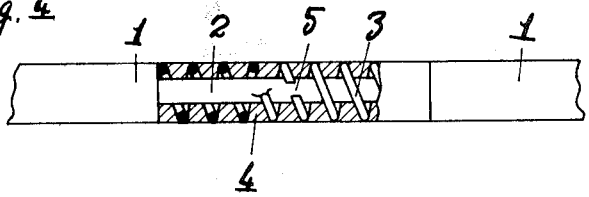
FIG. 4 is a front view of a thermal fuse according to the present invention, partly broken away, in which the coiled spring soldered as shown in FIG. 3 is cut at one portion.

Referring first to the embodiment shown in FIG. 1–FIG. 4, two conductors 1 (copper wire, aluminum wire, silver wire or any other electrically conductive metal wire) having the required diameter are arranged in such a fashion that their end surfaces are opposed each other on the same axial line, with an electrically insulative space therebetween, and a heat-resisting and insulative rod member (non-conductor) 2 is interposed between the two conductors 1 as it is inserted within a heat-resisting coiled spring 3. In this case, the coiled spring 3 is so provided that it is imparted with a required tension. This can be effected by engaging both ends of the coiled spring 3 with each of the opposing conductors and by determining the length of the rod member 2 so that the coiled spring 3 is put in a stretched condition. Both ends of the rod member 2 may be connected with the conductors in such a fashion that they are pressed against the end surfaces of the conductors, but in order to make the connection between the two conductors more tight, each end portion of the rod member may be fitted in a hole made at the end surface of the conductor or the conductor and the rod member may be bonded therein.

The coiled spring 3 is essential for opening (breaking) the circuit. As one of the methods of supporting the coiled spring between opposed conductors as the spring is in a stretched condition, both ends of the coiled spring may be engaged with both ends of the rod member, instead of end portions of the conductors.

After the coiled spring is interposed as it is in a stretched condition between the opposed conductors with the required space therebetween, both are soldered together by fusible metal 4 so as to fix the coiled spring in a stretched condition. In this case, the fusible metal should be a metal or allow having such a fusing point that it fuses at a predetermined temperature. As it is desirable that such fusible metal or alloy has no affinity to the rod member, the material of the rod member should be so selected as to meet this requirement. When the coiled spring and the rod member are soldered between the opposed conductors, the outside diameter of the coiled spring should preferably be the same as that of the conductors but may be larger or smaller. After the opposed conductors are connected through the medium of the coiled spring and fusible metal, the coiled spring is cut at its central portion or at a desired portion. Thus, the coiled spring is in such state that it is divided into two at the cut point 5, but so long as the fusible metal is in solid state, the coiled spring 3 is fixed in a stretched condition and both conductors 1 are kept connected electrically through the medium of the fusible metal and thus a circuit is formed.

Figure 5:
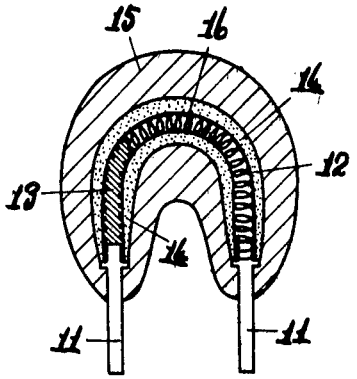
FIG. 5 is a sectional view of an embodiment of the present invention in which a coiled spring bent into a U-shape is interposed between two conductors in parallel.
Figure 6:
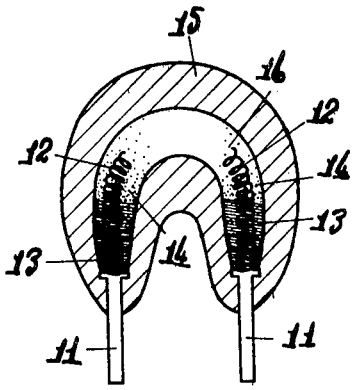
FIG. 6 shows the embodiment of FIG. 5, wherein the circuit is broken.

Referring to FIG. 5 and FIG. 6, two conductors 11 (for example, copper wire, aluminium wire, silver wire, silver wire or any other electrically conductive metal wire) having the required diameter and length are arranged in parallel in such a fashion that their ends are opposed to each other, with an electrically insulative space therebetween. A heat-resisting coiled spring 12 is interposed between the two conductors 11 as the spring is bent into a U-shaped configuration. In this case, end portions of the coiled spring 12 are fitted on the ends of the conductors 11, whereby the coiled spring 12 is biassed to become a straight line shape from the U-shape. That is, the spring is imparted with elasticity which is necessary for opening the circuit. The coiled spring bent into the U-shape is made integral with fusible meal 13 which fuses at a predetermined temperature. In this case, the fusible metal 13 may be stuck only to the outer circumference of the coiled spring or the coiled spring may be enclosed in its entirety with fusible metal.

The coiled spring having the U-shape is cut at a certain portion 16 (at its central portion, as shown in FIG.

5) so that the coiled spring may become straight and open the circuit upon fusing of the fusible metal. Even when the coiled spring is cut at a certain portion, it is maintained in the U-shape by virtue of the solid fusible metal and an electric circuit is formed between the conductors 11. The coiled spring is covered throughout its entire outer circumference with thermoplastic synthetic resin of a desired thickness. The thickness of this thermoplastic synthetic resin layer 14 is so determined that when the coiled spring is restored at its cut portion to the straight line shape upon fusing of the fusible metal and the circuit is opened, there is formed a hollow of such a size that the cut two coiled spring portions and the conductors in parallel are prevented from re-connection due to melting of the thermoplastic synthetic resin layer.

In order to maintain the external appearance, safety, efficient handling, etc. of the thermal fuse, the outer surface of the synthetic resin 14 is coated with insulating material 15 such as epoxy resin or ceramic.

The thermal fuse made in the above-mentioned way was tested for fusible characteristics by setting it in an atmosphere where the temperature was raised at the rate of 1° C./minute and by forming an electric circuit. The result was that as soon as the ambient temperature of the surrounding environment reached the fusing point of the alloy, the coiled spring fixed by the alloy was freed at its cut portion from fixing due to its elasticity upon fusing of the alloy and each of separated coiled spring portions was attracted to the connecting portion of respective conductor and thus the circuit was broken instantaneously.

The test result is as shown below.

Comparative test of fusible characteristics

| Inorganic type | Fusible characteristic: At initial stage | Fusible characteristic: After heating for 168 hrs. at 300° C. |
|---|---|---|
| Present invention (310° C.) | ±2° C. | ±3° C. |
| Conventional (310° C.) | ±7° C. | ±10° C. |
| Constant temperature tank 1° C./minute (temperature raising speed) | | |

The thermal fuse of the present invention shown in FIG. 1–FIG. 4 is such that the coiled spring is covered in its entirety with a fusible alloy and is cut at one portion, but the fusible alloy itself forms a circuit as it fixes the coiled spring. Therefore, it is free from early circuit breakage due to the outbreak of Joule heat caused by an electric load. Moreover, since the circuit breaks instantantaneously upon fusing of the fusible alloy, the thermal fuse has high precision. As it is simple in construction and its parts have versatility, the fuse can be manufactured easily in various types, ranging from very small size to large size.

In the thermal fuse shown in FIG. 5 and FIG. 6, the coiled spring is soldered in a fusible alloy as it is bent in a U-shape and is imparted with restoring force but is cut at one portion and thus an electric circuit is formed, while the fusible alloy fixes the coiled spring. With this arrangement, the fuse is free from the trouble resulting from the outbreak of Joule heat due to an electric current load (namely, early circuit breakage) and the circuit is broken upon fusing of the fusible alloy. Thus, the thermal fuse according to the present invention has such advantages that it is high in precision, simple in construction and easy to manufacture, ranging from very small size to large size, because of the versatility of the parts used.

What is claimed is:

1. A thermal fuse comprising:

two wire-shaped conductors formed of electrically conductive metal material, said two conductors being axially aligned with respective confronting end surfaces being spaced and defining therebetween a space;

a coiled spring having opposite ends fixed to respective confronting ends of said two conductors with said spring being under tension within said space;

a rod member of heat resistant and electrically insulating material positioned within said coiled spring and extending between said end surfaces of said two conductors;

said spring and said rod member being embedded in a solid fusible metal alloy material which has the property of melting at a predetermined temperature, said solid metal alloy material extending between said two conductors and thereby forming a current path therebetween; and said spring being cut, thereby defining two spring portions held in a tensioned condition by said solid fusible metal alloy material, whereby upon reaching said predetermined temperature said metal alloy material melts, thereby releasing said spring portions from said tensioned condition, such that said spring portions contract and instantaneously separate said metal alloy material and interrupt said current path.

2. A fuse as claimed in claim 1, wherein said spring is formed of heat resistant material.

3. A fuse as claimed in claim 1, wherein the exterior diameter of said solid fusible metal alloy material is equal to the diameter of said two conductors, such that said fuse as a whole has a generally cylindrical configuration.

4. A method of manufacturing a thermal fuse, said method comprising:

positioning two wire-shaped conductors formed of electrically conductive metal material such that said two conductors are axially aligned with respective confronting end surfaces being spaced and defining therebetween a space;

positioning a rod member of heat resistant and electrically insulating material within a coiled spring;

fixing opposite ends of a coiled spring to respective confronting ends of said two conductors, with said rod member extending between said end surfaces of said two conductors, and with said spring being under tension within said space;

solidifying a fusible metal alloy material, which has the property of melting at a predetermined temperature, such that said spring and said rod member are embedded in solid said metal alloy material, thereby forming a current path between said two conductors; and cutting said spring and thereby forming two spring portions held in a tensioned condition by said solid fusible metal alloy material.

5. A thermal fuse comprising:

two wire-shaped conductors formed of electrically conductive metal material, said two conductors being positioned to extend parallel to each other with respective ends spaced from each other;

a heat resistant coiled spring bent into a U-shaped configuration and having opposite ends fixed to respective said ends of said two conductors, with said spring having imparted thereto elasticity tending to return said spring to a linear configuration from said U-shaped configuration;

said spring, in said U-shaped configuration, being embedded in a solid fusible metal alloy material which has the property of melting at a predetermined temperature, said solid metal alloy material extending in a U-shaped configuration between said two conductors and thereby forming a current path therebetween; and said spring being cut, thereby defining two spring portions held in said U-shaped configuration by said solid fusible metal alloy material, whereby upon reaching said predetermined temperature said metal alloy material melts, thereby releasing said spring portions, such that said elasticity causes said spring portions to tend to return to linear configurations and instantaneously separate said metal alloy material and interrupt said current path.

6. A fuse as claimed in claim 5, further comprising: a layer of thermoplastic synthetic resin covering said U-shaped configuration of said solid fusible metal alloy material, and a coating of insulating material over said layer of thermoplastic synthetic resin.

7. A method of manufacturing a thermal fuse, said method comprising:

positioning two wire-shaped conductors formed of electrically conductive metal material such that said two conductors extend parallel to each other with respective ends spaced from each other;

bending a coiled spring into a U-shaped configuration, and fixing opposite ends of said spring to respective said ends of said two conductors, with said spring having imparted thereto elasticity tending to return said spring to a linear configuration from said U-shaped configuration;

solidifying a fusible metal alloy material, which has the property of melting at a predetermined temperature, such that said spring in said U-shaped configuration is embedded in a solid U-shaped configuration of said metal alloy material, thereby forming a current path between said two conductors; and cutting said spring and thereby forming two spring portions held in said U-shaped configuration by said solid fusible metal alloy material.

8. A method as claimed in claim 7, further comprising forming a layer of thermoplastic synthetic resin over said U-shaped configuration of said solid fusible metal alloy material, and forming a coating of insulating material over said layer of thermoplastic synthetic resin.

* * * * *